US007870887B1

(12) United States Patent
Bourque

(10) Patent No.: US 7,870,887 B1
(45) Date of Patent: Jan. 18, 2011

(54) SOLID COMPOSITION HAVING ENHANCED PHYSICAL AND ELECTRICAL PROPERTIES

(75) Inventor: John M. Bourque, Tucson, AZ (US)

(73) Assignee: Kryron Global, LLC, Tucson, AZ (US)

( * ) Notice: Subject to any disclaimer, the term of this patent is extended or adjusted under 35 U.S.C. 154(b) by 0 days.

(21) Appl. No.: 12/755,626

(22) Filed: Apr. 7, 2010

Related U.S. Application Data

(62) Division of application No. 12/268,315, filed on Nov. 10, 2008, now Pat. No. 7,767,121.

(51) Int. Cl.
*B22D 19/14* (2006.01)

(52) U.S. Cl. ..... 164/97; 164/98

(58) Field of Classification Search ..... 164/97, 164/98

See application file for complete search history.

(56) References Cited

U.S. PATENT DOCUMENTS

| | | | |
|---|---|---|---|
| 3,790,406 | A | 2/1974 | Sakai et al. |
| 4,039,403 | A | 8/1977 | Astley et al. |
| 4,061,815 | A | 12/1977 | Poole, Jr. |
| 4,632,806 | A | 12/1986 | Morikawa et al. |
| 4,877,647 | A | 10/1989 | Klabunde |
| 5,260,018 | A | 11/1993 | Dinger et al. |
| 5,480,706 | A | 1/1996 | Li et al. |
| 6,224,723 | B1 | 5/2001 | Prengaman et al. |
| 6,245,989 | B1 | 6/2001 | Iossel et al. |
| 6,649,306 | B2 | 11/2003 | Prengaman et al. |
| 6,664,003 | B2 | 12/2003 | Prengaman et al. |
| 6,703,104 | B1 | 3/2004 | Neal |
| 2003/0066677 | A1 | 4/2003 | Hustadt |
| 2004/0018375 | A1 | 1/2004 | Banno et al. |
| 2004/0112486 | A1 | 6/2004 | Aust et al. |
| 2004/0258604 | A1 | 12/2004 | Ryzhkow |
| 2005/0066805 | A1 | 3/2005 | Park et al. |
| 2006/0228481 | A1 | 10/2006 | Gros et al. |
| 2006/0248982 | A1 | 11/2006 | Yadav |
| 2006/0284338 | A1 | 12/2006 | Brown et al. |
| 2009/0255022 | A1 | 10/2009 | Smith et al. |

FOREIGN PATENT DOCUMENTS

| | | | |
|---|---|---|---|
| WO | 2006/135735 | A2 | 12/2006 |
| WO | 2006/135735 | A3 | 4/2009 |

OTHER PUBLICATIONS

Notification of Transmittal of the International Search Report and the Written Opinion of the International Searching Authority dated Mar. 25, 2010 in corresponding International Patent Application No. PCT/US09/63708 filed Nov. 9, 2009, 28 pages.

*Primary Examiner*—Kuang Lin
(74) *Attorney, Agent, or Firm*—Lewis and Roca LLP

(57) ABSTRACT

A method of making a treating wash includes mixing brass granules with acetone, mixing carbon nanotube material, iron pyrite granules and copper granules in the acetone brass mixture, and straining the liquid from the remaining solid material. Methods of treating materials such as brass granules, iron pyrite granules, carbon nanotube material, and brass granules comprises washing the materials in the treating wash, followed by straining and drying the materials.

2 Claims, 3 Drawing Sheets

SOLID COMPOSITION HAVING ENHANCED PHYSICAL AND ELECTRICAL PROPERTIES

CROSS-REFERENCE TO RELATED APPLICATIONS

This application is a divisional of U.S. patent application Ser. No. 12/268,315, filed Nov. 10, 2008 now U.S. Pat. No. 7,767,121, the entirety of which is incorporated by reference herein.

BACKGROUND OF THE INVENTION

1. Field of the Invention

The present invention relates to solid-material compositions having enhanced physical and electrical properties as well as products formed using the material and methods for making the material and the products.

2. The Prior Art

Products such as electrodes, electrode hangers, and bus bars for hydrometallurgy electrowinning (electroextraction) are known in the art. The electrodes are usually made from lead or lead alloys and the electrode hangers and bus bars are usually made from copper.

Body armor is usually formed from a series of plates each comprising a plurality of layers of different materials. Materials such as alloyed ceramics have been successfully employed in body armor plates.

BRIEF DESCRIPTION

A treating wash according to one aspect of the present invention comprises acetone, brass granules, carbon nanotube material, iron pyrite granules, and copper granules. A method of making a treating wash includes mixing brass granules with acetone, mixing carbon nanotube material, iron pyrite granules and copper granules in the acetone brass mixture, and straining the liquid from the remaining solid material. Methods of treating materials such as brass granules, iron pyrite granules, carbon nanotube material, and brass granules comprises washing the materials in the treating wash, followed by straining and drying the materials.

According to another aspect of the present invention, a method for forming a lead electrode, comprises providing a batch of molten lead, preparing a wash liquid comprising acetone, brass granules, carbon nanotube material, iron pyrite granules, and copper granules, mixed at high speed and strained, treating brass granules with the wash liquid, and straining and drying the brass granules to form treated brass granules, treating iron pyrite granules with the wash liquid, and straining and drying the iron pyrite granules to form treated iron pyrite granules, treating copper granules with the wash liquid, and straining and drying the copper granules to form treated copper granules, adding the treated brass granules, the treated iron pyrite granules, and the treated copper granules to the molten lead, pouring the molten lead into a pour mold coated with a thin layer of brass granules, allowing the lead to solidify into an ingot and then rolling the ingot in a pressure roller.

According to another aspect of the present invention, a method for forming one of a bus bar and a hanger bar for an electrode comprises providing a length of copper tubing, placing a first plug at a first end of the copper tubing, disposing a copper strip inside the copper tubing, preparing a wash liquid comprising acetone, brass granules, carbon nanotube material, iron pyrite granules, and copper granules, mixed at high speed and strained, treating brass granules with the wash liquid, and straining and drying the brass granules to form treated brass granules, treating magnetite with the wash liquid, and straining and drying the magnetite granules to form treated magnetite, treating iron pyrite granules with the wash liquid, and straining and drying the iron pyrite granules to form treated iron pyrite granules, treating copper granules with the wash liquid, and straining and drying the cooper granules to form treated copper granules, mixing and coating with a penetrating oil the treated brass granules, the treated magnetite, the treated iron pyrite granules, and the treated copper granules to form a fill mixture, filling the copper tubing with the fill mixture; and placing a second plug at a second end of the copper tubing.

According to another aspect of the present invention, a body-armor plate includes a first layer of treated brass granules, a first layer of treated glass-filled polymer, a first layer of treated iron pyrite granules, a metal sheet, a second layer of treated iron pyrite granules, a second layer of treated glass-filled polymer, and a second layer of treated brass granules. A method for making a body-armor plate comprises providing a body-armor plate mold, placing a layer of treated brass granules in the body-armor plate mold, placing a layer of treated glass-filled polymer over the layer of treated brass granules, placing a layer of treated iron pyrite over the layer of treated glass-filled polymer, placing a metal sheet over the layer of treated iron pyrite, placing a layer of treated iron pyrite over the metal sheet; placing a layer of treated glass-filled polymer over the layer of treated iron pyrite, placing a layer of treated brass granules over the layer of glass-filled polymer, placing a cover on the mold, heating the mold and placing the mold in a press.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

The present invention relates to solid-material compositions having enhanced physical and electrical properties as well as products formed using the material and methods for making the material and the products.

Various products can be made using the composition of the present invention. One aspect of the present invention is a wash or bath used to treat ingredients used to form the composition. Since the volume of the wash or bath will vary with the particular application, an illustrative example is given for formulating the wash using one gallon of acetone. Persons skilled in the art will appreciate that the amounts of the ingredients disclosed in the example can be linearly scaled to formulate larger or smaller batches of the wash.

Figure 1:
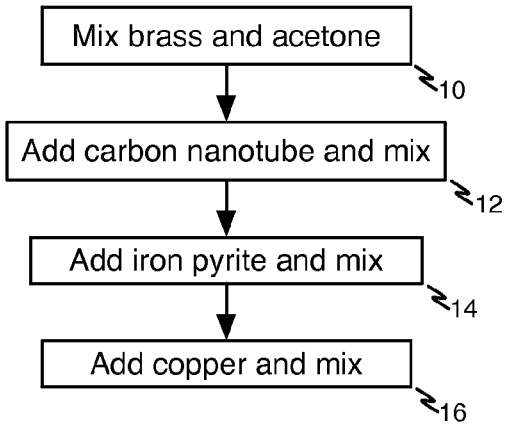
FIG. 1 is a diagram illustrating a process for making a treating wash according to one aspect of the present invention.

In one illustrative example shown in FIG. 1, at reference numeral 10, brass is mixed with acetone in a commercial blender. In the example, about 454 grams of brass (about 100 mesh or finer) is mixed with one gallon of acetone in a commercial blender at high speed for about 10 minutes or until a gold color appears at the surface of the acetone when the blender is stopped. At reference numeral 12, carbon nanotube material is added and mixed. In the illustrative example, about one gram of multi-walled carbon nanotube material is added and mixed at high speed for about 5 minutes. At reference numeral 14, iron pyrite is added and mixed. In the illustrative example, about 33.5 grams of iron pyrite having a grain size of about 0.125 inch is added and mixed for a minimum of about 3 minutes at high speed. At reference numeral 16, copper is added and mixed. In the illustrative example, about 517 grams of copper (about 35 mesh or finer) is added and mixed at high speed for about 8 minutes until a slurry begins to form on the surface after the blender is turned off. The order in which the carbon nanotube material, the iron pyrite, and the copper are added is not critical.

When the ingredients have all been mixed as described, the liquid is strained and may be used as a wash or bath. All of the strained solid matter may be stored for further use as disclosed herein. Once materials are processed, the wash liquid used may be collected and recycled by adding it to new batches of the wash liquid.

Once the wash liquid is formulated, constituent materials of products to be fabricated are washed using it. A sticky film merges with the constituent materials. The constituent materials are bonded together by drying and application of pressure, either in an oven or at room temperature.

Figure 2:
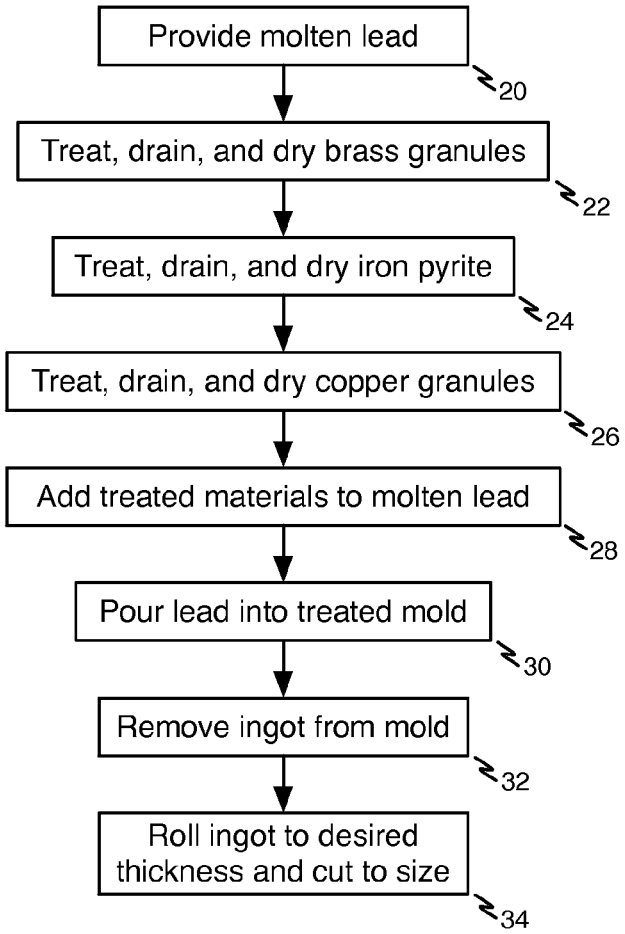
FIG. 2 is a diagram illustrating a process for making a calcium-tin lead anode according to another aspect of the present invention.

According to one aspect of the present invention, the composition is usefully employed in fabricating calcium-tin lead anode and cathode electrodes for hydrometallurgy electrowinning (electroextraction) processing applications such as refining processes performed in the mining industry and batteries. According to one example of a process for forming an anode described with reference to FIG. 2, at reference numeral 20, a batch of lead is melted. In the illustrative example, about 635 Kg of molten lead containing appropriate amounts of calcium and tin as is known in the art is provided in a suitable vessel at a temperature of about 800° F. At reference numeral 22, brass is treated with the wash liquid disclosed above. In the illustrative example, about 9 Kg of brass granules (about 100 mesh) are treated with the wash described above by running it over the granules. The wash liquid is drained off and the treated brass granules are allowed to dry. At reference numeral 24, iron pyrite is treated with the wash liquid. In the illustrative example, about 2.3 Kg of powdered iron pyrite (about 0.025 inch granules) are also treated as above. At reference numeral 26, copper is treated with the wash liquid. In the illustrative example, about 4.5 Kg of copper granules (about 100 mesh) are treated as above and allowed to dry. At reference numeral 28, the treated brass, iron pyrite, and copper are added to the molten lead. A mold in the desired shape of the anode is provided. A thin layer of about 100 mesh brass is evenly sprinkled on the full bottom of the lead pour mold plate, this allows the material to flow evenly from top to bottom as the lead is being poured and is cooling.

The bottom of the mold is lined with a mixture of the treated materials and the lead is then poured into the mold at reference numeral 30. As the treated-lead anode ingot is being cooled, it is removed from the mold at reference numeral 32 and transported to a rolling press where, at reference numeral 34, it is rolled to a desired thickness such as about 0.25 inches and cut to size into finished anodes having desired dimensions such as about 3 ft. by about 4 ft. by about 0.25 inches.

Anodes formed in accordance with the present invention are more conductive than conventional lead anodes. It is believed that these anodes will last longer than conventional anodes.

Figure 3:
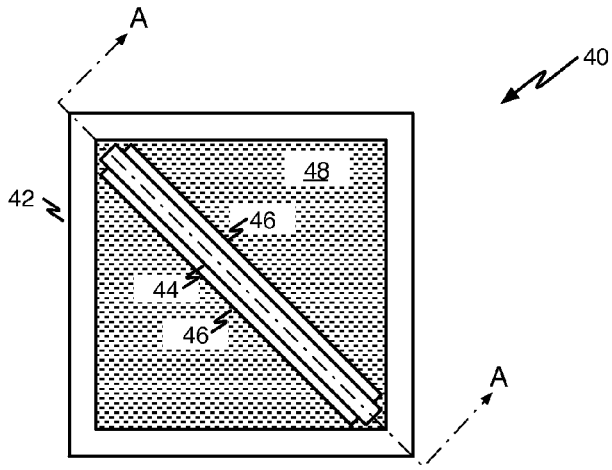
FIG. 3 is a diagram showing a radial cross sectional view of an illustrative electrode hanger bar according to another aspect of the present invention.
Figure 4:
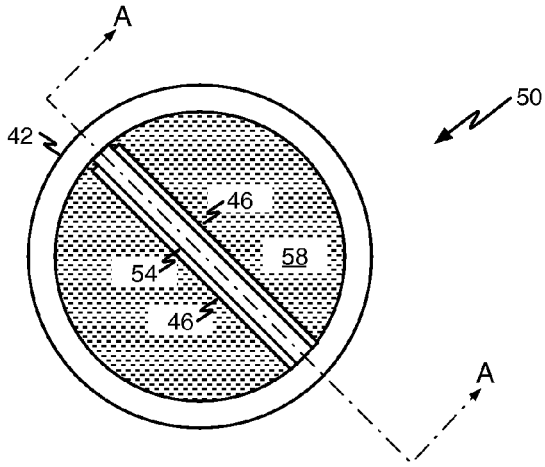
FIG. 4 is a diagram showing a radial cross sectional view of a second illustrative electrode hanger bar according to another aspect of the present invention.
Figure 5:
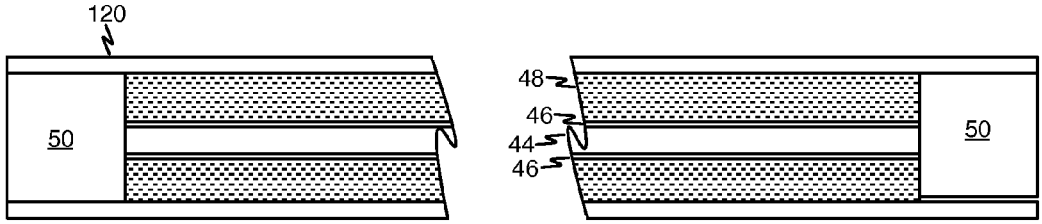
FIG. 5 is a diagram showing an axial cross sectional view of both the electrode hangars of FIGS. 4 and 5 taken along the line A-A.
Figure 6:
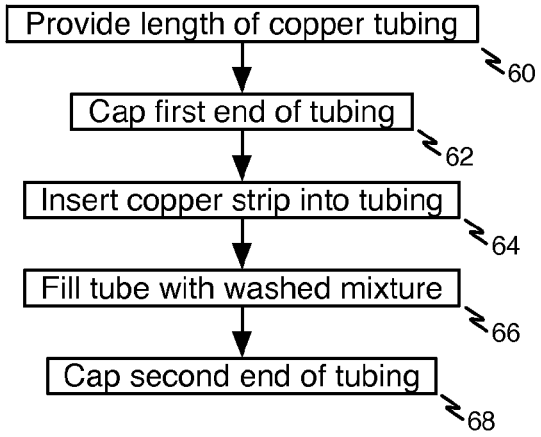
FIG. 6 is a diagram illustrating a process for making a hangar bar or bus bar according to another aspect of the present invention.
Figure 7:
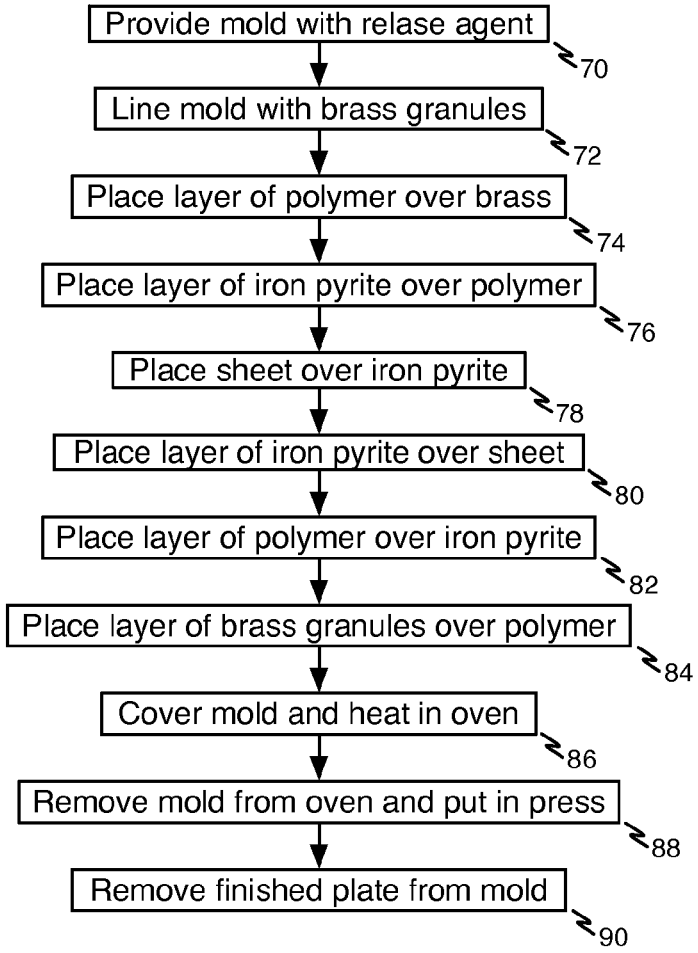
FIG. 7 is a diagram illustrating a process for making a body-armor plate according to another aspect of the present invention.

According to another aspect of the present invention, the composition is usefully employed in hanger bars used to support and supply current to anodes and cathodes. Different views of two illustrative examples of hanger bars according to the present invention are shown in FIGS. 3, 4, and 5. A process for fabricating the hangar bar is illustrated in FIG. 6. According to one illustrative embodiment of a hanger bar 40 according to the present invention, a suitable length of copper tubing 42 having, for example, a rectangular cross section (FIG. 3) or a circular cross section (FIG. 4), is provided (reference numeral 60 of FIG. 6). In one illustrative embodiment, the rectangular tubing may have wall dimensions of, for example, about 1.75 inches by 0.75 inches and a wall thickness of about 0.125 inches. As will be appreciated by persons of ordinary skill in the art, the wall thickness may be selected as a function of the weight of the electrode to be supported. One end of the tube is capped at reference numeral 62 and copper strip 44 having a length smaller than the length of the copper tubing by twice the length of a copper plug to seal the hanger bar and a width selected to provide a slip fit into the tubing is placed inside the copper tubing at reference numeral 64. Preferably, perforated steel strips 46 are affixed to one or both faces of the copper strip 44 by, for example, spot welding, soldering, or brazing prior to inserting the strip into the tubing. At reference numeral 66, the tube is filled with a mixture of brass, multi-walled carbon nanotube material, iron pyrite, and copper as described above and shown at reference numeral 48.

Plug 50, made out of a material such as copper, are used to seal the tubing and may be held in place by, for example, press fitting, welding, brazing or soldering. A copper plug 50 having a length of about 2 inches has been found to be satisfactory for this purpose although other lengths could be employed.

Prior to filling the tubing, the mixture of brass, iron pyrite, and copper 48 as described above is washed using the acetone solution and drained as described above. Additionally, about 2 gms of magnetite washed and drained using the acetone solution is added to the mixture. The drained mixture is coated with penetrating oils such as oils sold under the trademark WD-40 and is then packed into the tubing around the inserted strip. At reference numeral 68, a second plug 50 is inserted into the other end of the tubing and may be held in place by, for example, press fitting, welding, brazing or soldering.

According to another aspect of the present invention, a bus bar may be formed using the same process used to form the hanger bar. A center copper strip 44 is sandwiched between perforated steel sheets 46 and is disposed in a suitable length of copper tubing 42 as previously shown in FIGS. 3, 4, and 5. A mixture of copper, brass iron pyrite, and magnetite (reference numeral 48) treated as described herein is poured into the tubing, which is then capped with a plug 50 on each end.

The length of a bus bar can and does very from application to application, the particular length chosen to fit the application. One advantage of using such a bus bar is to provide a more conductive lead to both the anode and cathode, thus providing more current and less voltage drop to the cell.

According to another aspect of the present invention, electrodes including anodes and cathodes for zinc hydrometallurgy electrowinning (electroextraction) processes is formed using substantially the same mixing process as used for the copper anode with only one exception. That exception is the substitution of substantially equal amounts of additional brass and iron pyrite in place of the copper at reference numeral 26 in the process illustrated in FIG. 2. The brass should be high in zinc not copper; a brass composition having by weight about 68.5% copper, about 1.5% lead, and about 30% zinc has been found to be suitable for this application. The zinc hydrometallurgy electrode is made using the same process shown in FIG. 2 used to form the lead electrode, except that about 0.46% silver is substituted for the calcium-tin and the modified mixture containing the additional brass and iron pyrite is used in place of the copper.

According to another aspect of the present invention, the composition is usefully employed to form a plate that may be used in body armor. According to one example of a process for fabricating body armor according to the present invention, a mold for an armor plate is provided. At reference numeral 70, the mold is sprayed with a mold release agent. At reference numeral 72, the top and bottom mold plates are completely covered with brass powder (about 100 mesh). A depth of about 0.03125 inch has been found to be satisfactory. At reference numeral 74, a layer of glass-filled nylon polymer is washed using the wash liquid and is placed over the brass granules. A depth of about 0.125 inch has been found to be satisfactory. At reference numeral 76, a layer of iron pyrite is placed over the glass-filled polymer. A depth of about 0.125 inch has been found to be satisfactory. At reference numeral 78, a sheet formed from a material such as titanium (for example about 0.125 inch thick) or carbon steel (about 0.0625 inch thick) is placed above the pyrite layer. The process is then reversed, and at reference numeral 80, a layer of iron pyrite is placed over the sheet. A depth of about 0.125 inch has been found to be satisfactory. At reference numeral 82, a layer of glass-filled nylon polymer washed using the wash liquid is placed over the layer of iron pyrite. A depth of about 0.125 inch has been found to be satisfactory. At reference numeral 84, a layer of brass granules (about 35 mesh or finer) is placed over the layer of glass-filled nylon polymer. A depth of about 0.0625 inch has been found to be satisfactory.

At reference numeral 86, a cover is placed on the mold and the mold is placed in an oven at a temperature of, for example, 800° F. for an interval of about 15 minutes, or until the glass-filled nylon polymer begins to melt. At reference numeral 88, the mold is then removed from the oven and immediately placed in a press rated about 50-100 tons where the mold cover is uniformly pressed into the mold until the material cools to a temperature of about 140° F. At reference numeral 90, the finished placed is then released from the mold.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method for forming one of a bus bar and a hanger bar for an electrode comprising;

providing a length of copper tubing;

placing a first plug at a first end of the copper tubing;

disposing a copper strip inside the copper tubing;

preparing a wash liquid comprising acetone, brass granules, carbon nanotube material, iron pyrite granules, and copper granules, mixed at high speed and strained;

treating brass granules with the wash liquid, and straining and drying the brass granules to form treated brass granules;

treating magnetite granules with the wash liquid, and straining and drying the magnetite granules to form treated magnetite granules;

treating iron pyrite granules with the wash liquid, and straining and drying the iron pyrite granules to form treated iron pyrite granules;

treating copper granules with the wash liquid, and straining and drying the cooper granules to form treated copper granules;

mixing and coating with a penetrating oil the treated brass granules, the treated magnetite granules, the treated iron pyrite granules, and the treated copper granules to the molten lead to form a fill mixture;

filling the copper tubing with the fill mixture; and placing a second plug at a second end of the copper tubing.

2. The method of claim 1 wherein disposing a copper strip inside the copper tubing comprises disposing a copper strip sandwiched between two steel strips inside the copper tubing.

* * * * *